US007086856B1

(12) United States Patent
Lazarou

(10) Patent No.: US 7,086,856 B1
(45) Date of Patent: Aug. 8, 2006

(54) CARBON BAKING FURNACE

(75) Inventor: Rick Kiriakos Lazarou, Hawthorn (AU)

(73) Assignee: Lazar Enterprises PTY LTD, Victoria (AU)

( * ) Notice: Subject to any disclaimer, the term of this patent is extended or adjusted under 35 U.S.C. 154(b) by 0 days.

(21) Appl. No.: 09/744,801

(22) PCT Filed: Jul. 30, 1998

(86) PCT No.: PCT/AU98/00603

§ 371 (c)(1),
(2), (4) Date: Jan. 30, 2001

(87) PCT Pub. No.: WO99/06779

PCT Pub. Date: Feb. 11, 1999

(30) Foreign Application Priority Data

Aug. 1, 1997 (AU) ..... PO 8369

(51) Int. Cl.
*F27B 9/28* (2006.01)

(52) U.S. Cl. ..... 432/192; 432/11; 432/251; 264/29.5

(58) Field of Classification Search ..... 432/9, 432/11, 19, 128, 192, 249, 251; 423/445 R, 423/477.1; 264/29.3, 29.5; 23/314; 126/151, 126/269

See application file for complete search history.

(56) References Cited

U.S. PATENT DOCUMENTS 4,047,884 A * 9/1977 Heian ..... 432/21
4,120,645 A * 10/1978 Kohl et al. ..... 432/106
4,253,823 A * 3/1981 Holdner ..... 432/192
4,260,458 A 4/1981 Weber et al.
4,292,276 A 9/1981 Enomoto et al.
4,367,065 A * 1/1983 Cnare ..... 432/14
4,544,451 A 10/1985 Weber et al.
4,634,375 A * 1/1987 Hailey ..... 432/121
4,678,434 A 7/1987 Dahl et al.
5,100,314 A * 3/1992 Rierson ..... 432/103
5,146,469 A 9/1992 Svana
5,851,568 A * 12/1998 Huang ..... 425/356
6,042,801 A * 3/2000 Linga et al. ..... 423/445 R
6,436,335 B1 * 8/2002 Leisenberg ..... 266/44

FOREIGN PATENT DOCUMENTS

EP 0 255 611 B1 10/1993

OTHER PUBLICATIONS

Derwent Abstract Accession No. 32151, Jul. 1, 1976 (SU Patent No. 757 828).
Derwent Abstract Accession No. 54555, Jul. 12, 1977 (SU Patent No. 777 382).
Derwent Abstract Accession No. 46436, Jun. 18, 1974 (SU Patent No. 499 484).
Derwent Abstract Accession No. 96623, Jun. 24, 1977 (SU Patent No. 815 444).
Derwent Abstract Accession No. 46437, Jun. 21, 1974 (SU Patent No. 499 485).
Jacobson et al., "A New Ring Furnace Concept: Design and Operation", Denver, CO 1987 w/Norway dialog search Abstract.

* cited by examiner

*Primary Examiner*—Gregory Wilson
(74) *Attorney, Agent, or Firm*—Sughrue Mion, PLLC

(57) ABSTRACT

A carbon baking furnace comprising a refractory lined kiln defining a baking path, further comprising a means for substantially continuously receiving green carbon articles, means for packing said green carbon articles in a sacrificial medium, a means for substantially continuously displacement of the packed carbon articles through said baking path and a means for substantially continuously removing baked carbon articles from the kiln.

29 Claims, 2 Drawing Sheets

CARBON BAKING FURNACE

BACKGROUND OF THE INVENTION

The present invention relates to the baking of carbon, in particular to the baking of carbon anodes such as for use in aluminium smelters. The present invention further relates to a carbon baking furnace, to a process for the baking of carbon articles and articles so baked.

The conversion of alumina to aluminium metal by electrolysis results in a substantial consumption of carbon anodes. Molten aluminium is deposited onto a carbon cathode and simultaneously oxygen is deposited on and consumes the carbon anode of the electrolytic cell. Typically, up to 0.4 tonnes of carbon are consumed for every tonne of aluminium produced. As a result, aluminium smelters have a requirement for a substantial and continuous supply of carbon electrodes. It is common for smelters to manufacture carbon anodes on site as an integral part of the aluminium production process.

SUMMARY OF THE INVENTION

The manufacture of carbon anodes comprises producing "green" anode blocks and baking the "green" blocks to produce anodes suitable for use. The production of "green" blocks involves the mixing of crushed coke or anthracite with a binding agent which, for example, contains coal tar pitch. The viscous mixture is then pressed to form "green" anode blocks. Depending on the smelters' requirements, "green" anodes may typically weigh from a few hundred kilograms to more than a tonne. The mixture of coke and pitch binder is generally solid at room temperature and softens at temperatures over about 50° C. Volatile components are released at temperatures between 50° C. and 400° C. When subjected to further heating over a period of time, to about 1200° C., the anode hardens, resulting in improved physical properties, such as electrical conductivity and resistance to oxidation.

Carbon anodes are typically manufactured in carbon baking furnaces which are often referred to as ring-type furnaces where "green" anode blocks are loaded into large pits, covered with sacrificial coke and baked. The furnace is generally a concrete tub lined with refractory materials to provide a number of pits into which a column of green anodes may be loaded for baking, usually about six deep. Each pit is typically surrounded by two flues for heating the anodes, the flue-walls also being lined with refractory materials. As each pit is loaded, "green" anodes are packed in with sacrificial coke. These furnaces typically require baking cycles of about 2 to 3 weeks which includes preheating and the time that the baked anode is left in the pit to cool prior to removal.

The thermal cycling of these types of carbon baking furnaces causes adverse effects on the refractory materials, concrete and other ceramic components. The refractory materials deform with heat and time, resulting in altered brick dimensions. Further, packing coke material may lodge into expansion gaps which, together with temperature cycling, leads to large structural deformation of walls and ultimately failure.

Deformed flue walls must be regularly replaced as excessive tub-wall deformation results in an inefficient operation and necessitates furnace rebuilding. Costs associated with regular flue-wall replacement and maintenance of joints and tub-walls can be as high as 50% of the overall anode baking costs.

We have now found a furnace configuration which overcomes or at least substantially alleviates the problems associated with the conventional ring-type furnaces.

According to the present invention there is now provided a carbon baking furnace comprising a refractory lined kiln defining a baking path, further comprising a means for substantially continuously receiving green carbon articles, means for packing said green carbon articles in a sacrificial medium, a means for substantially continuously displacing of the packed carbon articles through said baking path and a means for substantially continuously removing baked carbon articles from the kiln.

In a second aspect there is provided a process for baking carbon articles, said process comprising he steps of substantially continuously loading green carbon articles into a refractory lined kiln, said kiln defining a baking path, packing said green carbon articles in a sacrificial medium, substantially continuously displacing the carbon articles through said baking path and substantially continuously removing baked carbon a articles from the kiln.

Advantageously, the present invention provides carbon articles which have been subjected to more consistent temperature treatments. This results in articles of improved baked quality. In the manufacture of baked carbon anodes for use in aluminium smelting operations, improved baked quality contributes significantly to cell efficiency. Temperature gradients in excess of 150° C. in a single pit of ring type furnaces are not uncommon. Such high temperature gradients may result in thermo-mechanical degradation of the anode matrix. The present invention may reduce or eliminate cracking of the anodes which may otherwise result from excessive temperature gradients in the baking process.

It will be understood that the term "substantially continuously" refers to a continuous mode of operation whereby carbon articles are passed continuously through the kiln. The carbon articles are passed through the kiln at either a uniform rate or may involve a periodic or step-wise passage through the kiln. This will be determined primarily by the means for receiving and removing the articles from the kiln.

The refractory lined kiln may be any convenient refractory lined kiln which incorporates a baking path through which the carbon articles may pass and which is capable of heating the carbon articles up to the desired baking temperatures, typically bout 1200° C. to 1300° C.

Preferably the refractory lined kiln may comprise a number of heating zones whereby each heating zone is capable of maintaining the carbon articles at a desired temperature. The refractory lined kiln of the present invention may be operated continuously thereby permitting each heating zone to be operated at an equilibrium temperature with little or no thermal cycling. The operation at equilibrium temperatures permits greater fuel efficiency as fuel which would otherwise be spent in the reheating of furnace components in ring-type furnaces may be eliminated. In the present invention fuel need only be used to provide the necessary calorific values required to bake the anodes (not heating and reheating refractory substructures).

Furthermore, the operation of the refractory lined kiln under equilibrium conditions allows structural materials such as refractories, concrete supports and other ceramic products to be maintained at relatively constant temperatures over an extended period, substantially reducing thermal cycling of these materials. The furnace may then be able to operate for longer periods without extensive maintenance or rebuilding. Furnace rebuilds costing tens of millions of dollars are standard in ring-type furnaces. Such rebuilds may take place at approximately five-yearly intervals. Thermal cycling of refractories will be substantially reduced according to the present invention and concomitantly the useful life of the furnace will be greatly extended.

Refractories may also advantageously be selected according to the heating zone in the kiln in which they are intended for use thereby permitting the efficiency and operating life of the furnace to be optimised. For example, in a preheat/volatiles extraction zone, low permeability refractories with high resistance to volatiles attack, such as those refractories used in incinerators are preferred. In the high temperature zone, refractories with high resistance to thermomechanical degradation are preferred. Alumina silicates, such as those having greater than 45% alumina may be used in these and other zones of the kiln.

The refractories may include guides, such as protrusions, to position the carbon articles within the baking path defined by the refractory lined kiln. It is desirable that the baking path be substantially linear so as to permit the carbon articles to be readily conveyed along the baking path with a minimum requirement for actuators or conveyors to operate or be located within the kiln. Preferably, the sacrificial medium is sufficient to support and guide the carbon articles without the need for actuators to be located in the high temperature regions of the kiln.

Preferably the kiln may comprise a number of heating zones in order to provide optimum control of temperature treatment of the carbon articles. Defined thermal gradients along the carbon baking furnace make it possible to separate heating and volatile extraction zone. It is preferable that the kiln comprise a first heating zone whereby the carbon article is heated to a temperature whereby any volatile materials are removed from the furnace to reduce chemical degradation of the refractories and/or other kiln components and to reduce the possibility of explosion within the kiln. The extraction of volatile organic compounds from the kiln permits these potentially toxic compounds to be contained. Optionally these volatile organic compounds may be extracted and pumped into the heating zone with the fuel and combusted as part of the heating of the kiln. This minimises the likelihood of any emissions of volatile materials such as pitch fumes from the furnace into the environment.

Furthermore, the containment of pitch fumes is particularly desirable as pitch condensates are extremely difficult to handle and costly to eliminate. Current technologies, due to design limitations, are unable to fully combust or efficiently contain these toxins. Pitch fumes escape from the furnace environment or condense within the ringmains. Pitch condensates are extremely difficult to handle and are costly to eliminate. The present invention makes it possible to reduce the risk of exposing workers to these highly toxic substances.

Second and subsequent heating zones may be used to control the rate of increase of the temperature of the carbon articles as they substantially continuously pass through the baking path. The rate at which the carbon articles pass through the baking path and the configuration of the heating zones in the kiln will determine the temperature gradient across the carbon articles and the heat treatment profile to which the carbon articles are subjected.

Preferably, the kiln defines a vertical baking path whereby the carbon articles are displaced downwardly through the baking path as a result of the weight of the carbon article and the weight of the sacrificial medium and subsequent carbon articles stacked above. The rate at which the carbon articles pass through the baking path may conveniently be regulated by substantially continuously removing the bottom most baked carbon article from the kiln in a manner whereby the weight of the carbon articles and the sacrificial medium is supported within the kiln and the remaining carbon articles are substantially continuously displaced through the baking path.

Alternatively the kiln may define a substantially horizontal baking path or a baking path on an inclined plane whereby the carbon articles are substantially continuously displaced through the baking path by a push rod or other convenient means.

The means for substantially continuously receiving green carbon articles may be any convenient means, dependent on the configuration and orientation of the refractory lined kiln and the baking path. We have found that the use of a conveyor and a hydraulic ram is particularly suited to a kiln having a vertical baking path wherein the green carbon articles are received at the top of the kiln. The conveyor may position the green carbon article adjacent to the top of the kiln and the hydraulic ram place the green carbon article into the top of the baking path.

The means for packing the green carbon articles in a sacrificial medium may be any convenient means dependent on the morphology of the sacrificial medium. Preferably the sacrificial medium is a friable packing coke. The means for packing the green carbon articles in a friable sacrificial medium may include a hopper fitted with a suitable nozzle whereby the sacrificial medium is spread over and around the green carbon article. Preferably the sacrificial medium occupies the remaining space in the kiln once the carbon articles have been located therein. It is desirable to reduce the amount of free space in the kiln.

Refractory spacers are probably used to separate the carbon articles in the kiln so as to prevent the carbon articles being baked together and to alleviate difficulties in separating the baked carbon articles when they are removed from the baking path. Suitable spacers may be made from consumable materials such as aluminium sheets, cardboard, or paper. Alternatively the spacers may be made from refractory or carbonaceous materials, such spacers may be reused or recycled.

The means for the substantially continuous displacement of the carbon articles through the baking path may include means whereby the carbon articles are forced or pushed through the baking path. Preferably gravity, or the weight of the column of carbon articles in a vertical baking path is used to urge the carbon articles through the baking path and the substantially continued displacement of the carbon articles is achieved by retarding or braking the movement of the lower or lowest carbon articles thereby exercising control over the rate at which the carbon articles pass down the kiln.

The means for substantially continuously removing the baked carbon article from the kiln may be any convenient means depending on the configuration and orientation of the kiln. In the preferred configuration and orientation of the kiln where the baking path is substantially vertical and the carbon articles pass down the kiln under their own weight and the weight of the sacrificial medium, a preferred means for substantially continuously removing the baked carbon articles from the kiln includes the use of hydraulic rams and conveyor belts. The bottom-most baked carbon article is preferably supported such as by a hydraulic ram while the adjacent baked carbon article is engaged by a second pair of opposed rams so as to restrain or support all but the bottom-most baked carbon article. The bottom-most baked carbon article is then lowered or positioned by the first mentioned hydraulic ram onto a conveyor belt for storage and/or use.

The sacrificial medium may be any medium which will protect the carbon articles during the baking process. The sacrificial medium may preferentially react with or absorb the oxygen in the kiln prior to its reaction with the carbon in the articles being baked. It is preferred that the sacrificial medium be friable to permit it easy incorporation around the carbon articles and to permit the easy movement of the carbon articles within the kiln. The sacrificial medium may be selected so as to provide an optimum balance of rendering the carbon articles easily moveable through the furnace and providing sufficient protection of the carbon articles from oxygen contained within the kiln. Preferably the sacrificial medium is packing coke having a maximum particle size of less than 15 mm.

It is also desirable for the sacrificial medium to conduct heat efficiently to the carbon articles. For this reason, it is desirable that the amount of sacrificial medium used is sufficient to provide adequate protection for the carbon articles from oxygen, permit the easy movement of the carbon articles in the kiln and to provide efficient beat transfer.

Desirably the sacrificial medium may be collected from the furnace and, so far as is capable, be recycled for packing further green carbon articles. For example, the flow of this medium may be controlled by the use of a pendulous carbon trough, the flow rate being proportional to the period of oscillation.

The furnaces of the present invention may be arranged such that a plurality of such furnaces are positioned adjacent to one another so as to permit the efficient use of equipment and heating values in the fuel.

We have found that improved control of temperature permits more even heat treatment of the carbon articles and the manufacture of carbon articles having higher baked quality. Additionally, anode deformation, otherwise known as "slumping", during baking which a problem in ring furnaces is insignificant. Green anodes subjected to loads at varying temperatures reveal dimensional instability in the 25° C. to 150° C. temperature range. This is directly related to the temperature zone at which anode volatiles are emitted. We have found that anodes (regardless of load) maintain their structural integrity at temperatures beyond 150° C. and the degree of permanent deformation is less than 0.5%.

Current carbon baking furnace designs operate within narrow parameters, the distance between the anodes and flue walls is critical to achieving optimum baking. In the past this inflexibility in design has presented operators with costly refurbishment when a node design changes are required. The carbon baking furnace of the present invention may more easily be modified to accommodate anode design changes and to control carbon anode temperature, such as by varying the rate at which they are passed through the various temperature zones and the temperature of said zones. Furthermore, baking temperatures may be optimised to improve in anode baking.

The carbon baking furnace of the present invention is able to accommodate anodes of varying size with minimal structural change. Temperature profiles can be tailored by altering configuration of the columns heat exchange systems.

Advantageously, the carbon baking furnace of the present invention may result in a significant reduction in fuel consumption, more uniform baking of anodes and efficient toxic volatiles elimination. The substantially continuous flow of anodes and coke through the carbon baking furnace eliminates the need for expensive and labour intensive loading and unloading procedures as in existing furnace designs. Large multipurpose cranes costing more than 10% of the overall capital budget of ring type furnaces requiring high ongoing operating costs may be eliminated. The present invention permits a fully automated anode and packing coke loading and unloading system, along with the resultant increased productivity.

In general, the continuous furnace of the present invention will require approximately one fifth of the surface area needed to accommodate an equivalent ring-type furnace. The continuous furnace of the present invention may typically be between 20 m and 30 m high, with anode velocities between 3 and 4.5 m/day.

Throughout this specification and the claims which follow, unless the context requires otherwise, the word "comprise" or variations such as "comprises" or "comprising", will be understood to imply the inclusion of a stated integer or group of integers but not the exclusion of any other integer or group of integers.

The present invention will now be further described with reference to the accompanying drawings. In the drawings the carbon articles are represented by anodes for use in the aluminium smelting industry. It will be understood that the present invention applies equally to the baking of other carbon articles.

BRIEF DESCRIPTION OF THE INVENTION

DETAILED DESCRIPTION OF THE INVENTION

Figure 1:
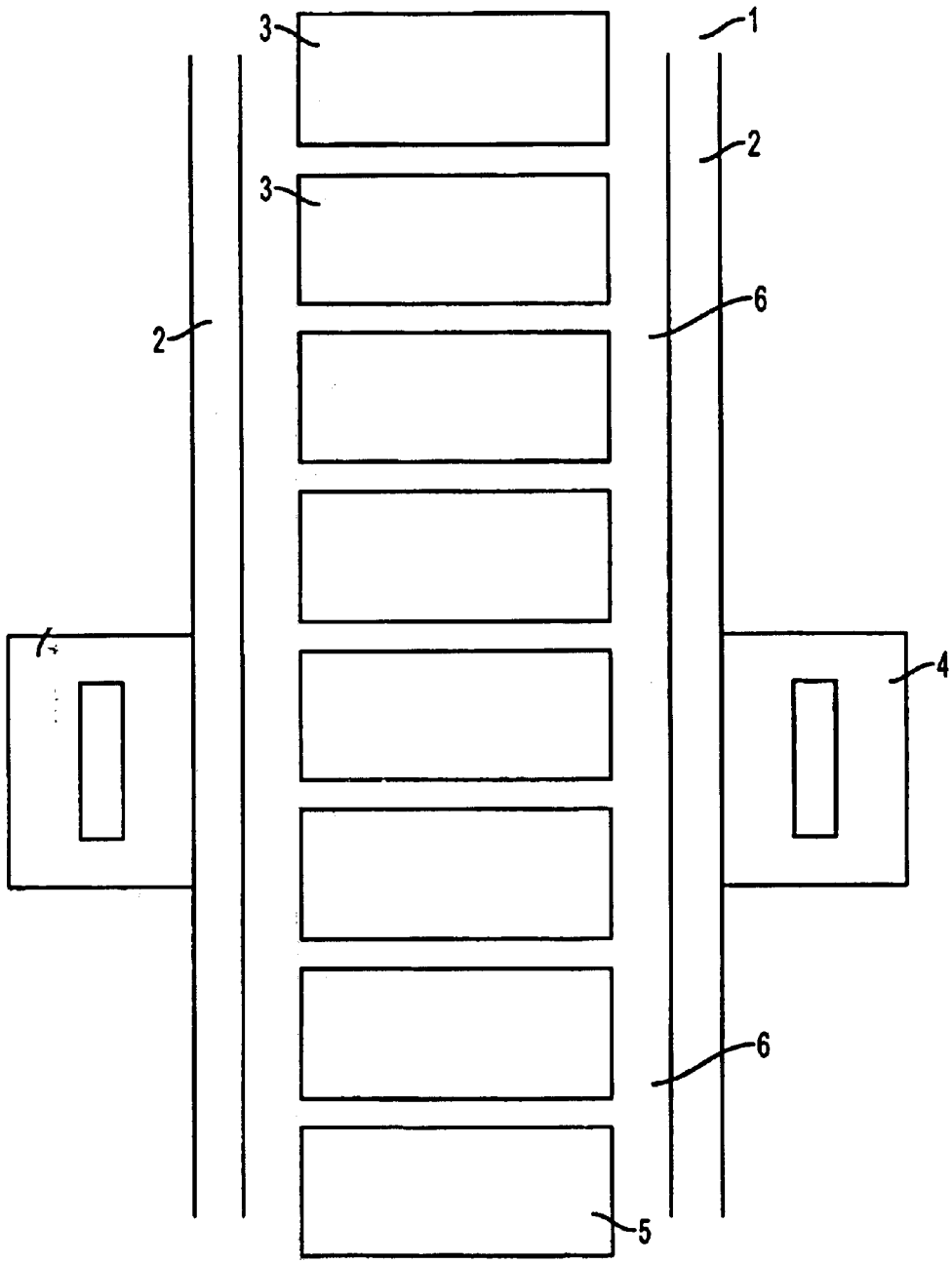
FIG. 1 is a cross sectional view of the carbon baking furnace of the present invention.

The carbon baking furnace(1) shown in FIG. 1 incorporates a refractory lined kiln(2) and a heating means(4). Green carbon anodes(3) are encased in packing coke(6) and are substantially continuously fed through the heating zone generated by the heating means(4). Baked carbon anodes(5) are produced after passing through the heating zone. Means for receiving green carbon anodes (not shown) and means for removing baked carbon anodes (not shown) assist to control the rate at which the anodes pass through the heating zone and the temperature profile to which they are subjected.

Figure 2:
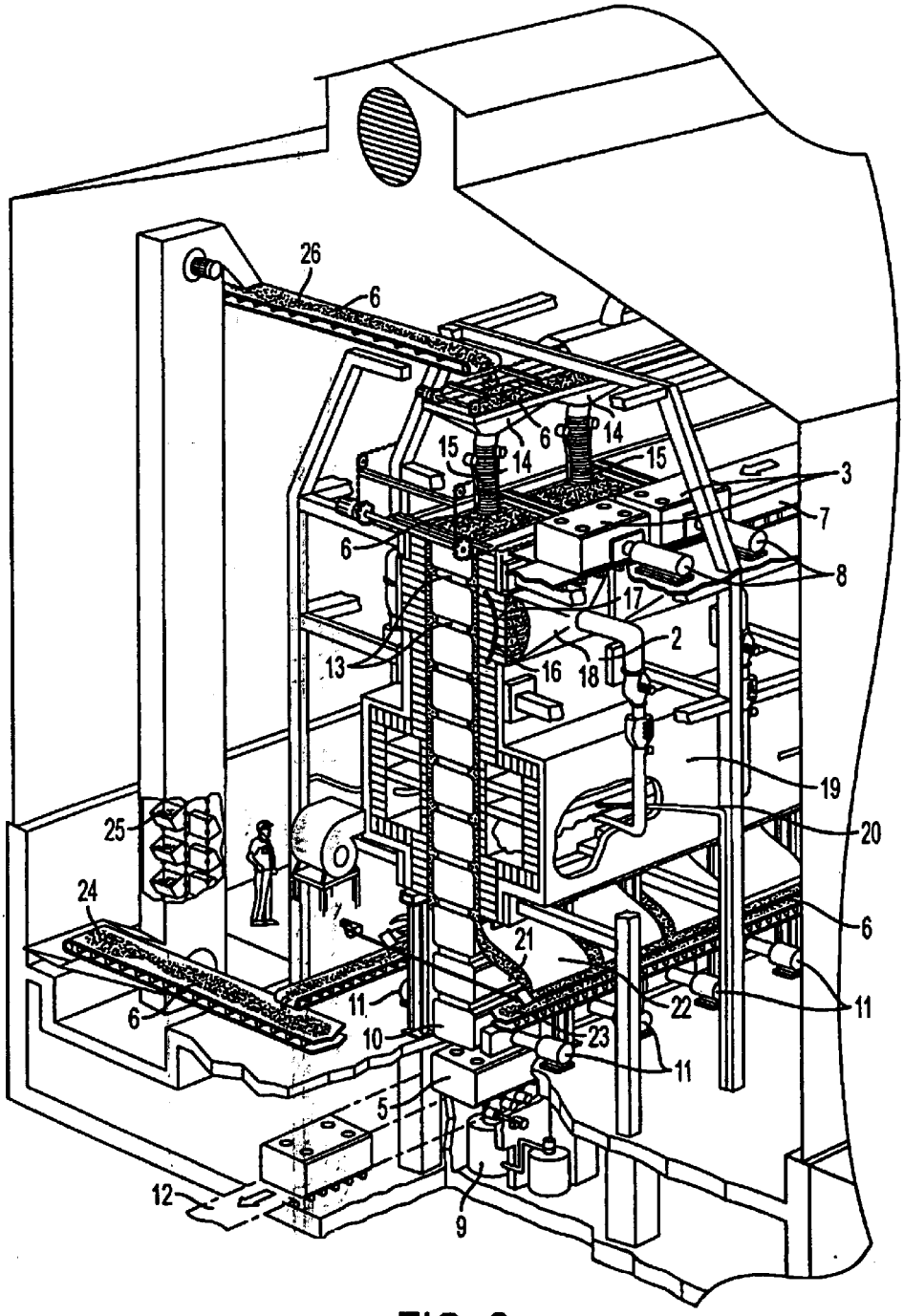
FIG. 2 is a cutaway perspective diagram of a preferred embodiment of the carbon baking furnace of the present invention.

FIG. 2 shows a preferred configuration of the carbon baking furnace of the present invention. FIG. 2 is a cutaway perspective drawing. Green carbon anodes(3) are positioned adjacent the refractory lined kiln(2) by conveyor belt(7). Hydraulic rams(8) position the green carbon anodes (3) over the baking path of refractory lined kiln(2). The bottom-most baked carbon anode(5) is lowered by hydraulic ram(9) after the adjacent carbon anode(10) is engaged by hydraulic rams(11). Baked carbon anode (5) is then positioned by hydraulic ram(9) on conveyor belt(12) for storage and/or use. Hydraulic ram(9) engages baked carbon anode(10), hydraulic rams (11) disengage baked carbon anode(10) and hydraulic ram(9) lowers baked carbon anode(10) into the position previously occupied by baked carbon anode(5) as a result the column of anodes moves downwards in a substantially continuous manner.

Green carbon anode(3) is positioned on a spacing element (13). Packing coke(6) is then fed by hopper(14) through nozzle(15) to fill the space surrounding the green carbon anode(3) in the kiln(2). As the carbon anodes pass through the kiln(2) the carbon anodes enter a volatile extraction zone(16). Volatiles such as pitch fumes are extracted through holes in the refractory materials(17) through extraction unit(18). The extracted fumes are fed into the heating unit(19) in addition to fuel in order to provide sufficient calorific values to raise the temperature of the carbon anodes to the desired baking temperature. The fuel is fed into the heating unit(19) through nozzle(20).

After the anodes have passed through the high temperature zone adjacent to the heating u7nit(19) the packing coke(6) is removed from the baked anodes by scrapers(21). The packing coke(6) which has been removed from the baked carbon anodes is then transported on conveyor belts (23) and (24) and returned to the hoppers(14) via continuous buckets(25) and conveyor belt(26).

Those skilled in the art will appreciate that the invention described herein is susceptible to variations and modifications other an those specifically described. It is to be understood that the invention includes all such variations and modifications which fall within its spirit and scope. The invention also includes all of the steps, features, compositions and compounds referred to or indicated in this specification, individually or collectively, and any and all combinations of any two or more of said steps or features.

What is claimed is:

1. A carbon baking furnace for carbon anode blocks comprising:

a refractory lined kiln defining a baking path through which plural carbon anode blocks are displaced as they are baked, a receiving zone adjacent a first end of the baking path in which green carbon anode blocks are substantially continuously placed into said first end of the baking path, a supply of sacrificial medium for packing said green carbon anode blocks in said sacrificial medium prior to the packed carbon anode blocks being substantially continuously displaced through said baking path to form baked carbon anodes, and a discharge zone adjacent a second end of the baking path in which said baked carbon anodes are substantially continuously discharged from the kiln.

2. A carbon baking furnace according to claim 1 wherein said refractory lined kiln comprises a plurality of heating zones.

3. A carbon baking furnace according to claim 2 wherein said refractory lined kiln comprises a first heating zone capable of heating the green carbon anode blocks to remove volatile organic compounds and a high temperature heating zone for baking the carbon anode blocks.

4. A carbon baking furnace according to claim 3 wherein the high temperature zone comprises a plurality of heating zones.

5. A carbon baking furnace according to claim 1 wherein said baking path is substantially linear.

6. A carbon baking furnace according to claim 1 wherein the refractory lined kiln comprises guides to position the carbon anode blocks within the baking path.

7. A carbon baking furnace according to claim 1 wherein said baking path is substantially vertical.

8. A carbon baking furnace according to claim 7 wherein the green carbon anode blocks are substantially continuously placed into the kiln in the receiving zone by a conveyor and a hydraulic ram whereby the conveyor positions the green carbon anode blocks adjacent to the top of the substantially vertical baking path and the hydraulic ram positions the green carbon anode blocks into the top of the baking path.

9. A carbon baking furnace according to claim 7 wherein the baked carbon anodes are substantially continuously discharged from the substantially vertical baking path in the discharge zone by a plurality of hydraulic rams and a conveyor whereby the bottom-most baked carbon anode is supported by a hydraulic ram and the adjacent baked carbon anode is engaged and supported by a pair of opposed rams while the bottom-most baked carbon anode is positioned by the first mentioned hydraulic ram onto the conveyor.

10. A carbon baking furnace according to claim 7 wherein the packed carbon anode blocks are substantially continuously displaced through the baking path under gravity.

11. A carbon baking furnace according to claim 1 comprising a hopper for the sacrificial medium, the hopper being fitted with a nozzle for spreading the sacrificial medium over and around each green carbon anode blocks.

12. A carbon baking furnace according to claim 1 wherein said sacrificial medium is packing coke having a maximum particle size of less than 15 mm.

13. A carbon baking furnace according to claim 1 comprising scrapers for removing the sacrificial medium form the baked carbon anodes downstream of the kiln.

14. A process for baking carbon anode blocks, said process comprising the steps of:

substantially continuously loading green carbon anode blocks into a refractory lined kiln, said kiln defining a baking path through which plural carbon anode blocks are displaced from a first end to a second end as they are baked, packing said green carbon anode blocks in a sacrificial medium prior to displacing the packed carbon anode blocks through said baking path, substantially continuously displacing the packed carbon anode blocks through said baking path to form baked carbon anodes, and substantially continuously discharging the baked carbon anodes from the kiln at the second end of the baking path.

15. A process for baking carbon anode blocks according to claim 14 wherein the packed carbon anode blocks are displaced through the kiln at a uniform rate.

16. A process for baking carbon anode blocks according to claim 14 wherein the packed carbon anode blocks are displaced through the kiln at a step-wise rate.

17. A process for baking carbon anode blocks according to claim 14 wherein the refractory lined kiln operates at equilibrium temperatures.

18. A process for baking carbon anode blocks according to claim 14 wherein the green carbon blocks are heated in a first heating zone of the refractory-lined kiln to remove volatile organic compounds from the carbon anode blocks, and wherein the volatile organic compounds are extracted from the kiln.

19. A process for baking carbon anodes blocks according to claim 14 wherein said baking path is substantially linear.

20. A process for baking carbon anode blocks according claim 14 wherein the packed carbon anode blocks are guided through the baking path by guides in the refractory lined kiln.

21. A process for baking carbon anode blocks according to claim 14 wherein said baking path is substantially vertical.

22. A process for baking carbon anode blocks according to claim 21 wherein the green carbon anode blocks are substantially continuously loaded into the kiln by a conveyor and a hydraulic ram whereby the conveyor positions the green carbon anode blocks adjacent to the top of the substantially vertical baking path and the hydraulic ram positions the green carbon anode blocks into the top of the baking path.

23. A process for baking carbon anode blocks according to claim 21 wherein the packed carbon anode blocks are substantially continuously displaced through the baking path under gravity.

24. A process for baking carbon anode blocks according to claim 21 wherein the rate at which the packed carbon anode blocks pass down the substantially vertical baking path is controlled by retarding or braking the movement of the lower or lowest baked carbon anode.

25. A process for baking carbon anode blocks according to claim 21 wherein the baked carbon anodes are substantially continuously discharged from the substantially vertical baking path by supporting the bottom-most baked carbon anode with a hydraulic ram, engaging and supporting the adjacent baked carbon anode with a pair of opposed rams, and using the first mentioned hydraulic ram to position the bottom-most baked carbon anode onto a conveyor.

26. A process for baking carbon anode blocks according to claim 14 wherein the sacrificial medium is stored in a hopper fitted with a nozzle and is spread over and around the green carbon anode blocks by means of the nozzle.

27. A process for baking carbon anode blocks according to claim 14 wherein said sacrificial medium is packing coke having a maximum particle size of less than 15 mm.

28. A process for baking carbon anode blocks according to claim 14 wherein the sacrificial medium that has been displaced through the baking path with the packed carbon anode blocks is separated from the baked carbon anodes downstream of the refractory lined kiln.

29. A process for baking carbon anode blocks according to claim 28 wherein the sacrificial medium is separated from the baked carbon anodes by means of scrapers.

* * * * *